US006085681A

United States Patent [19]

Morton

[11] Patent Number: 6,085,681

[45] Date of Patent: Jul. 11, 2000

[54] MOORING HOOK

[76] Inventor: Douglas A. Morton, 3551 State Rte. 3, Fulton, N.Y. 13069

[21] Appl. No.: 09/213,086

[22] Filed: Dec. 16, 1998

Related U.S. Application Data

[60] Provisional application No. 60/068,101, Dec. 19, 1997.

[51] Int. Cl.[7] ..... B63B 9/00

[52] U.S. Cl. ..... 114/221 R; 294/19.1

[58] Field of Search ..... 114/221 R, 230.1, 114/230.15, 230.2, 230.25, 230.26, 230.28, 230.29; 294/19.1

[56] References Cited

U.S. PATENT DOCUMENTS

| | | | |
|---|---|---|---|
| 1,470,861 | 10/1923 | Meyer . | |
| 1,830,208 | 11/1931 | Norling . | |
| 2,550,770 | 5/1951 | Calemmo | 114/230 |
| 2,700,252 | 1/1955 | Paganelli | 47/1 |
| 2,704,052 | 3/1955 | Wood | 119/153 |
| 2,730,985 | 1/1956 | Wingate | 114/230 |
| 2,813,736 | 11/1957 | Archer et al. | 289/17 |
| 2,916,316 | 12/1959 | Archer et al. | 294/19 |
| 3,774,953 | 11/1973 | Babcock | 294/19 R |
| 3,813,122 | 5/1974 | Wemyss | 294/19 R |
| 4,492,511 | 1/1985 | Bilsing | 414/744 A |
| 4,645,408 | 2/1987 | Mizuno | 414/733 |
| 4,751,892 | 6/1988 | Sechel et al. | 114/221 R |
| 5,058,306 | 10/1991 | Sienel | 43/5 |
| 5,082,318 | 1/1992 | Held et al. | 294/19.1 |

*Primary Examiner*—S. Joseph Morano
*Assistant Examiner*—Andrew D. Wright
*Attorney, Agent, or Firm*—Trapani & Molldrem

[57] ABSTRACT

An extendible mooring hook has a pair of jaw members spring biased to an open position with a shuttle removably retained on one jaw member. A detent mechanism engages the shuttle member when the jaw members close around a mooring post and pulls the shuttle, and attached mooring line, around the mooring post when the jaw members return to their open position. The pole portion can be extended, and a incorporates a traveler mechanism to compensate for changes in cable length so that cable tension is maintained when the pole is extended.

15 Claims, 4 Drawing Sheets

MOORING HOOK

This application claims benefit to U.S. provisional application 60/068,101 filed Dec. 19, 1997.

BACKGROUND OF THE INVENTION

This invention is directed to a mooring device for passing a mooring line around a post, pole or cable, for example, for holding the boat in position in a canal lock while the boat is being raised or lowered. The invention is also directed to a mooring hook that is extendible, and which has a cable adjusting mechanism within it so that the mooring hook can be actuated at any selected length.

Devices for passing a line or rope around a post or for attaching a line to a mooring ring or eye can be useful in navigation, especially for boats navigating canals. Generally, canal locks have mooring posts at intervals within the locks, and the boats tie up to these when being raised or lowered. The posts are located in recesses on the walls of the locks, and are attached at top and bottom. The usual procedure is to lean out over the side of the boat and pass the line around the post by hand. This is a difficult procedure, and can be dangerous if there is any wind. Lock design is not all that standardized, and many locks have cables instead of posts, and a few simply have ropes hanging from the tops of the lock walls. The mooring hook device has to be able to accommodate any of these. Because the distance to reach the mooring post can depend on the size of the boat and the position within the lock, the pole portion of the unit should be extendible. The mooring hook should accommodate different size boats, or different distances to the posts fore and aft, without the deckhand having to lean dangerously over the rail. Because it is sometimes necessary to reach down below the gunwale to attach the mooring line, the operator should be able to articulate the business end of the device, relative to the pole portion, to a suitable angle. However, these features are not available on any available mooring hook, boat hook, or similar device.

There have been attempted solutions to this problem, and a few of these are found in various patents.

Wemyss U.S. Pat. No. 3,813,122 describes a device for attaching a mooring line in which a shuttle, to which the line is tied, is carried on a two-armed fork, and is pivotable on each arm of the fork. The shuttle swings down from one side to get around a post, pylon, or eye, and then swings the other way on the other side to let the line be withdrawn back to the boat. In this case, the shuttle is a large cumbersome member, and expensive to replace if broken or if dropped into the water. Also, this device is difficult to use in a canal lock environment if there is a tight space behind the mooring post. The device can be used only with rigid mooring posts or the like, as the shuttle has to be driven into the mooring post in order to swing the shuttle on the fork.

Wingate U.S. Pat. No. 2,730,985 another device with a shuttle that is pulled off a hook portion to pass a line around an object. Again, as in the Wemyss arrangement, the shuttle is rather large, and the available space has to accommodate it, and has to be thrust against the mooring device to operate it.

Another arrangement is shown in Held et al. U.S. Pat. No. 5,082,318, and employs a latch gate with a parrot hook to pass a loop of hitching line around an object.

OBJECTS AND SUMMARY OF THE INVENTION

Accordingly, it is an object of this invention to provide a mooring device that is simple to use, does not involve expensive or elaborate shuttle parts, which can be used to pass a mooring line around any of a variety of mooring devices, and which avoids the drawbacks of the prior art.

It is another object to provide a mooring hook with a pole or stick portion that can be elongated or shortened as necessary and automatically adjusts the cable length within the pole portion so that the cable does not have to be adjusted by the user.

The boat hook or stick, according to an aspect of this invention, has a pole portion (which can be extendable). At the distal end is a cable-actuated hook, with a main fork portion attached to the pole; a pair of jaws that are pivoted at the ends of the two sides of the fork portion; and a slide that transfers cable force from the cable to the two jaws. The slide can travel proximally-distally for some distance between the two fork sides. At the end of one jaw is a slot or receptacle that holds a small shuttle, onto which the end of the mooring line is attached. In some embodiments, the shuttle could be a loop or knot formed in the mooring line itself. However, it is preferred to use a durable metal member as the shuttle. The preferred shuttle has a ring to which the line is tied, and a loop that is caught by a snap spring detent on the other jaw. The detent can have a spring-actuated tooth that engages the loop when the jaws are closed together. Then when the jaws are opened the detent retains the ring in the second jaw, and the shuttle is pulled free of the receptacle or slot in the first jaw. When the stick is pulled back, the line has been passed around the mooring post. The jaws are spring loaded so that they are normally biased open. Preferably the device is cable actuated, and the pole portion is tubular with a cable passing through it. There is a lever actuator handle on the proximal end.

Another feature is the cable arrangement, which permits the stick or pole to be extended or collapsed without having to re-adjust the cable tension. This is accomplished by using a traveler, that is a pair of free pulleys carried in a small block within the tubular pole portion, and first and second cable halves. The cable halves are anchored respectively to the handle portion and the jaw portion of the stick. The handle part has an outer tube member and an inner tube member, with the latter having a slot running axially along it. The access for the cable to the anchor for the jaw side is via this slot.

The above and many other objects, features, and advantages of this invention will become apparent from the ensuing detailed description of a preferred embodiment, which is illustrated in the Accompanying Drawing.

DETAILED DESCRIPTION OF A PREFERRED EMBODIMENT

Figure 1:
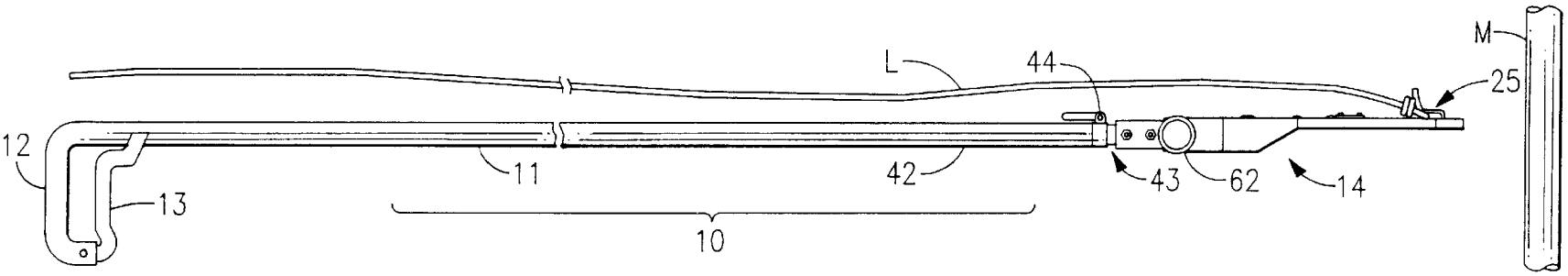
FIG. 1 is a side view of a mooring hook arrangement according to one preferred embodiment of the present invention.

Now with reference to the Drawing, FIG. 1 shows a mooring hook 10 of this invention for passing a mooring line L around a mooring post M. The mooring hook is not limited to use in canal locks, but may be used for general docking and mooring purposes. Here the mooring hook 10 has an elongated tubular pole 11, with a handle 12 at its proximal end, shown with a squeeze lever 13 for actuating a cable. At the distal end of the pole is a hook or jaw portion 14. This is shown in more detail in FIGS. 2 and 3. In this embodiment, the jaw portion has a bifurcated fork portion 15 that is attached to the pole 11 and a pair of jaw members or fingers 16 and 17 that are pivotally mounted on the ends to the two sides of the fork portion. There is a slide 18 that is mounted on the fork portion 15, with a post or bolt 19 passing through a proximal-distal slot 20 in the slide 18. The slide enjoys at least limited motion back and forth. There are rigid connecting links 21 and 22 connecting the slide to the right and left jaw members 16 and 17, respectively. The slide distributes force evenly between the two jaw members, and ensures that they move to a closed position when the slide 18 is pulled proximally. A pair of springs 23, 23 bias the slide 18 distally, that is, in the direction so that the two jaw members 16, 17 return to the open position as shown. There are pivot members 24, e.g., pins, that mount the bases of the jaws 16, 17 to the distal ends of the fork 15.

As shown here, the slide 18 has a concave forward edge to accommodate the round shape of the mooring post M, and the fork portion 15 has a similar concave forward edge.

Figure 5:
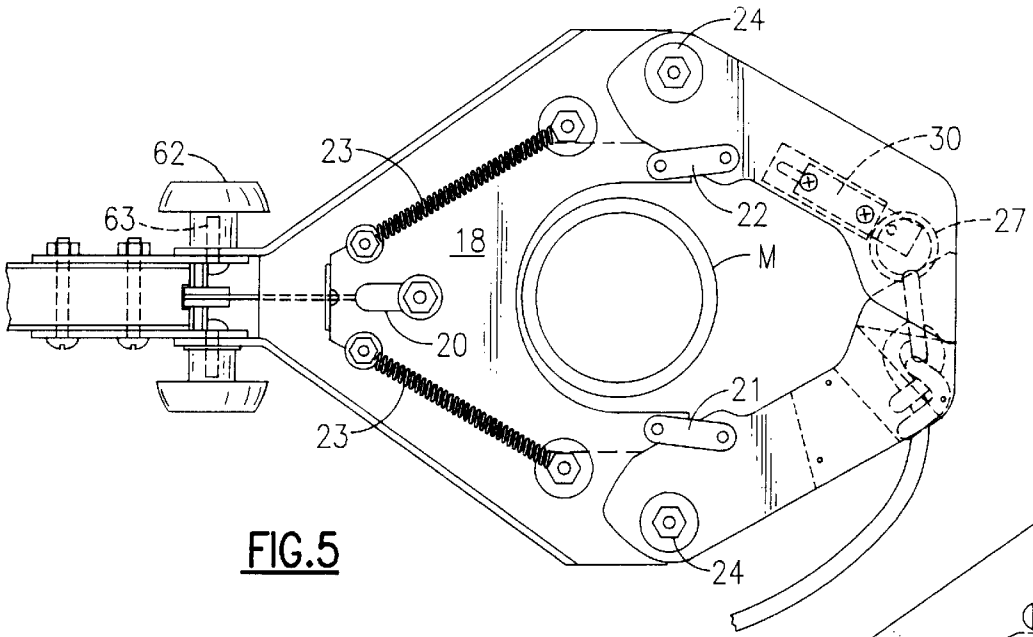
FIG. 5 is a bottom plan view showing the jaw fully closed with the shuttle engaging the detent mechanism.
Figure 7:
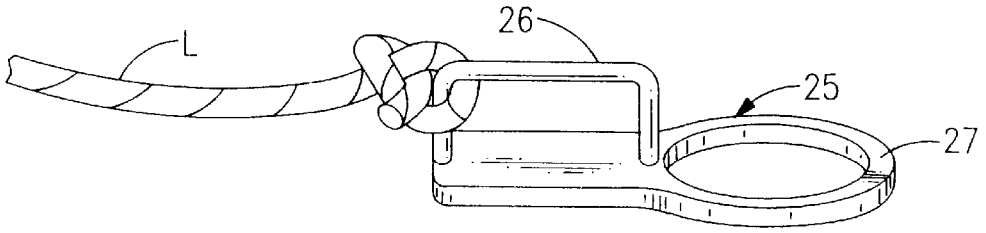
FIG. 7 is a perspective view of the shuttle of this embodiment.
Figure 8:
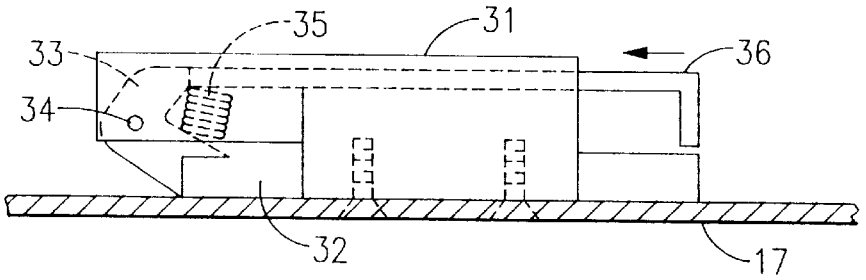
FIG. 8 is an elevation of the detent mechanism of this embodiment.

A metal shuttle or eye member 25 accommodates the line L and can be constructed as generally shown in FIG. 7. As shown there, the shuttle 24 has a loop 26 on one end to which the line L is tied or otherwise attached, and also has an eye or ring portion 27, which is intended to snap fit into a detent mechanism when the two jaws close together. A receptacle 28 is provided on the one jaw 16, and the shuttle 25 is removably retained in a slot 29 in this receptacle. A detent mechanism 30 is mounted on the other jaw member 17, and is formed of a block 31 that is attached, e.g., by screws, to the jaw member 17. As shown in FIG. 8, the block 31 is designed to provide a clearance 32 for the eye portion 27 of the shuttle 25. An L-shaped tooth 33 is mounted on a pivot pin 34 in the block, and is biased by a spring 35 so that it protrudes into the clearance 32. When the jaw members 16 and 17 close together, as shown in FIG. 5, the eye portion 27 deflects the tooth 33 and then the spring 35 snaps the tooth back down to retain the shuttle. Then when the jaws 16, 17 return to their open position, the detent 30 pulls the shuttle 25 out of the retainer 28 and, in effect, passes the line L behind the mooring post M. Then, the boatman can pull the mooring hook 10 back into the boat with the line L passing behind the mooring post M. A release pin 37 can be pushed in the direction shown by the arrow in FIG. 8 to deflect the tooth 33 upwards so that the boatman can remove the shuttle 25 and line L. At this point, both ends of the line L are available to the boatman and the boat can be snugged up to the mooring post.

In this embodiment, the closing of the jaw members 16 and 17 is carried out by means of the actuator handle 12, i.e., by squeezing the lever 13. An actuator cable 40, that is, an inextensible but flexible wire, extends through the tubular pole 11 and is connected at its proximal end to the lever 13 and at its distal end is affixed to a lug 41 on the slide 18. Squeezing the lever 13 pulls the slide 18 in the proximal direction and closes the jaw members 16, 17. When the lever 13 is released, the springs 23 pull the slide 18 in the distal direction to return the jaw members 16, 17 to their open position.

While in some embodiments the pole 11 can be a single piece of fixed length, it is also possible for the pole 11 to be of adjustable length, as shown here. In this embodiment, the pole 11 is an extendible tubular pole with a proximal tube portion 42 affixed to the handle 12 and a distal tube portion 43 affixed to the head or hook member 14. The distal tube portion fits slidably within the proximal tube portion 42, and a clamp 44 of any of various known designs locks the pole 11 at any selected length. The pole 11 of this embodiment is preferably extendible over a range from about seven-and-a-half feet (closed or collapsed) to about twelve feet (fully extended). A smaller version, for use with small craft, can be extendible from about four-and-one-half to about seven-and-one-half feet. However, in the case of a collapsible or extensible pole 11, it is necessary to allow for the cable 40, and to ensure that the cable length is accommodated with changes in pole length. If this is not done, then the cable has to be manually adjusted each time the pole length is changed so the squeeze lever 13 will reliably actuate the jaw members. One mechanism for accomplishing this is illustrated in FIG. 9.

As shown here, the pole 11 is formed of three tubes, namely the distal tube 43, to which the jaw portion 14 is connected, the outer proximal tube 42 which is affixed at its proximal end to the handle 12, and an inner proximal tube 45 that is coextensive with the tube 42 and which is also affixed at its proximal end to the handle 12. The distal tube 43 is positioned radially between the outer and inner proximal tubes 42, 45 and slidably fits into an annular space defined between the tubes 42 and 45. There is an axial slot or gap 46 through the wall of the interior tube 45, shown at the top in this view. A finger 47 may be formed at the proximal end of the distal tube 43, and here the finger 47 projects radially into the slot 46 and serves as an anchor.

The cable 40 that extends through the extendable pole 11 is here formed as first and second cable halves 40A and 40B, and these are respectively attached to the lever 13 and the slide 18 of the hook member 14. A traveler 50 positioned within the tube 45 joins the two cable halves 40A and 40B, and provides adjustment of cable length when the pole 11 is extended or collapsed. The traveler 50 is formed of a block 51 that slides freely within the tube 45, and carries a first pulley wheel 52 and second pulley wheel 53. The first cable half 40A extends from the handle end, passes over the pulley wheel 52 and is anchored or attached to the finger 47. The second cable half extends from the cable lug 41 on the slide, through the tube 43, over the pulley wheel 53 and is secured to an anchor pin 54 at the distal end of the interior tube 45. While this drawing view shows the cable halves 40A and 40B in one plane for purpose of illustration, it is also possible that the two pulleys 52, 53 and the cable halves 40A and 40B be oriented about 90 degrees apart so that the cables and pulleys clear each other.

Figure 9:
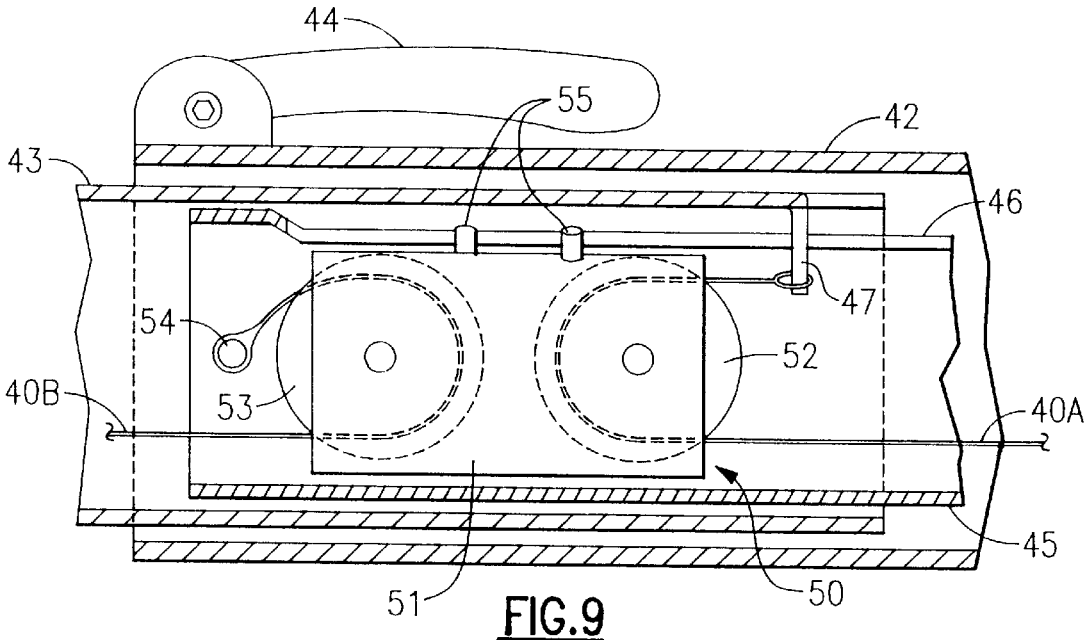
FIG. 9 is a cross section of the extendible pole portion, featuring the self-adjusting cable mechanism.

As also shown in FIG. 9, anti-rotation pins 55 extend radially out from the body of the block 51 into the slot or gap 46 to engage the sides or walls of the slot.

As shown in FIGS. 2 to 6, the hook portion 14 can have an articulated neck 60 secured to the distal end of the pole 11. This provision allows the boatman or deckhand to adjust the mooring hook to reach down below the rails or gunwales of the boat without having to lean dangerously over the rail. Here, the fork portion 15 has left and right ears 61 formed at its proximal end, and joined to the end of the neck 60 to pivot on a horizontal axis. Knobs 62 on either side fit respective threaded bolts 63. The knobs can be turned to loosen them and permit the hook portion 14 to be oriented at a suitable angle relative to the pole 11. The knobs are then tightened to lock the mooring hook into this angulated orientation. A small pulley 64 is provided at the axis of articulation to maintain tension on the cable 40 when the head or hook portion is angled.

Figure 2:
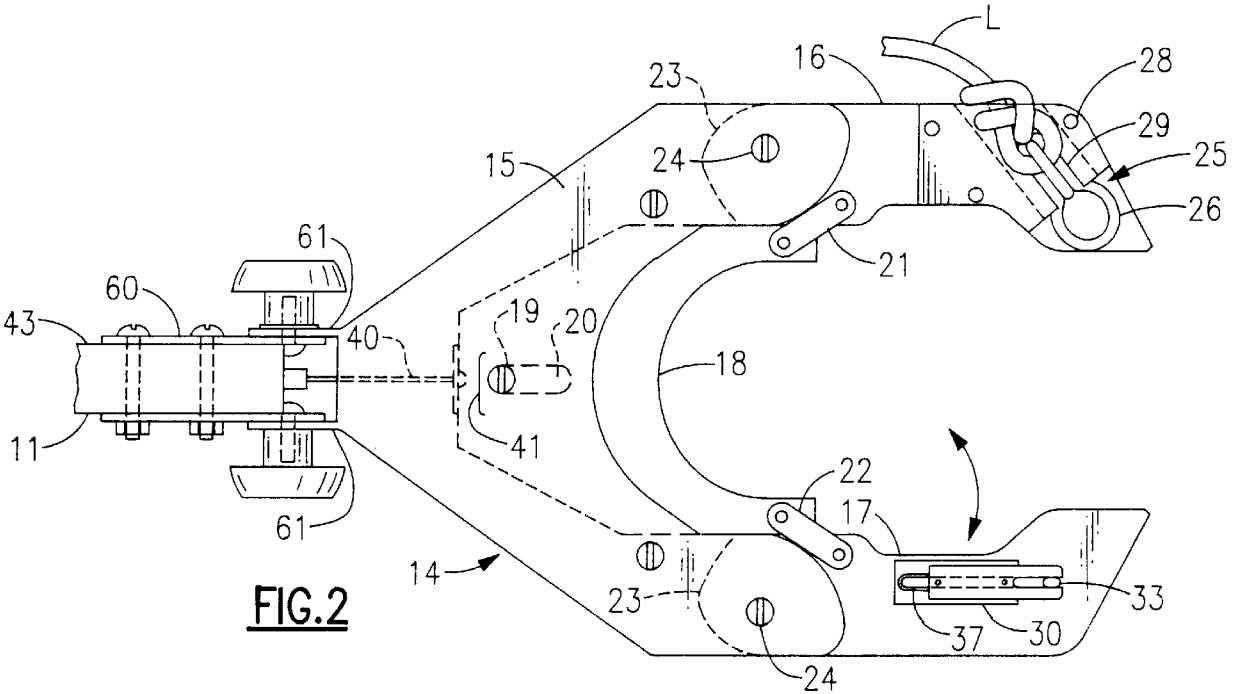
FIG. 2 is a top plan view of the jaw or hook portion of this embodiment, shown in its open position.
Figure 3:
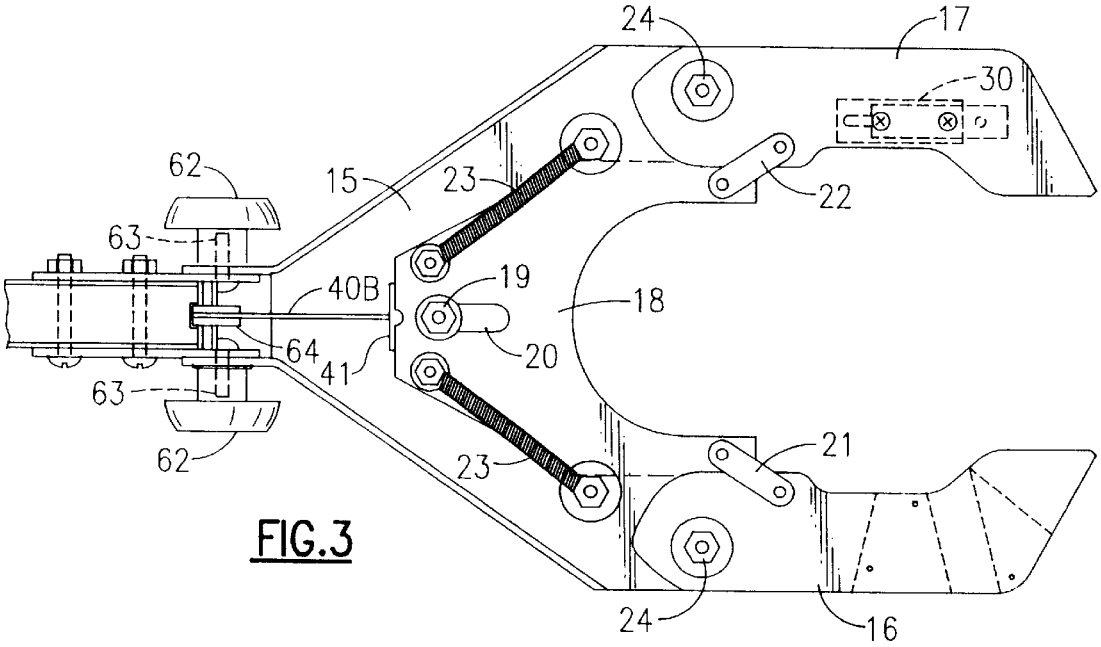
FIG. 3 is a bottom plan view thereof.
Figure 4:
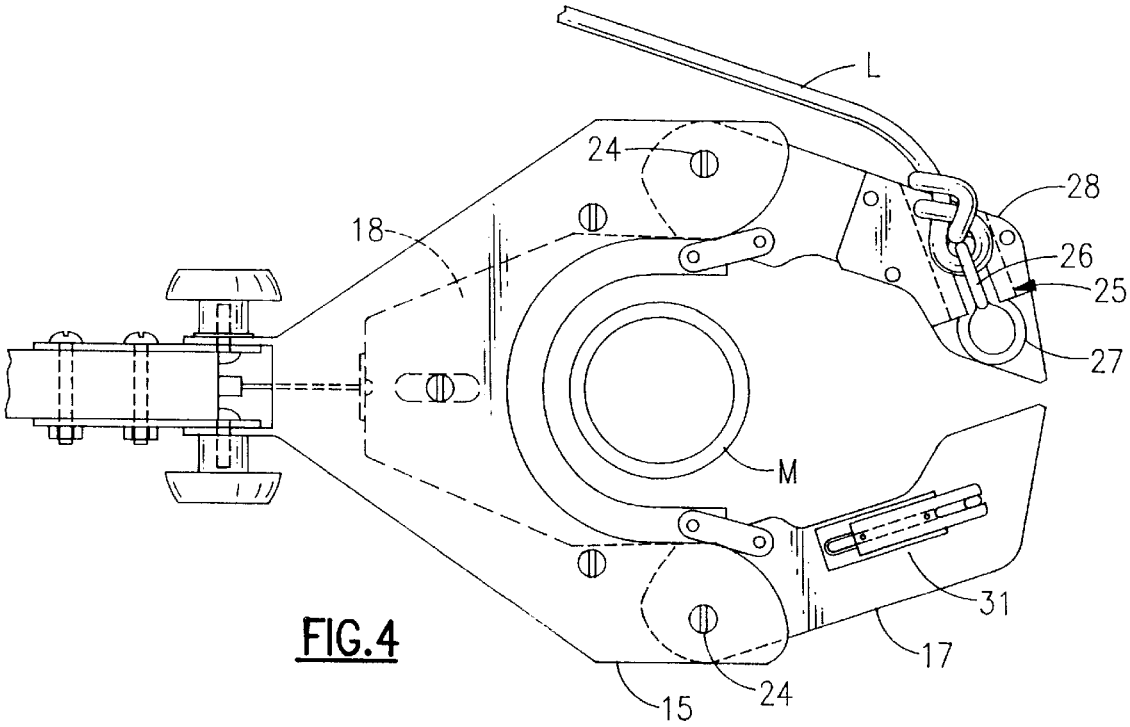
FIG. 4 is a top plan view showing the jaw portion partially closed.
Figure 6:
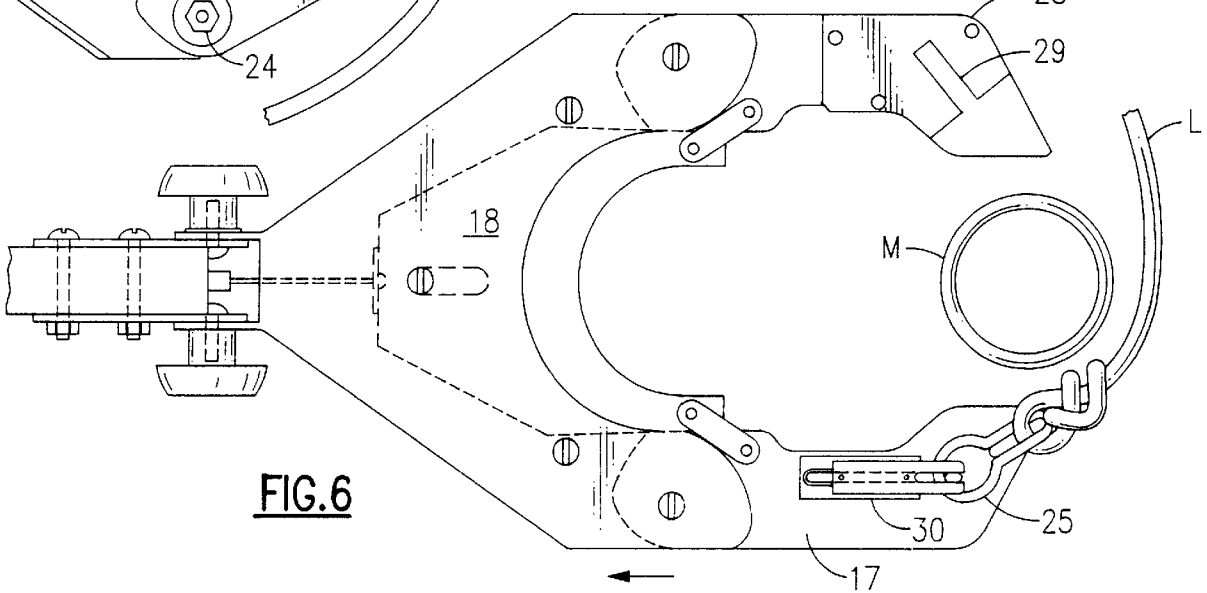
FIG. 6 is a top plan view showing the jaws re-opened with the shuttle retained in the detent mechanism.

The general operation of this device can be explained in FIGS. 2 to 6. FIGS. 2 and 3 show the mooring hook with the jaws 16, 17 in the open or ready position, with the line L attached to the loop 26 of the metal shuttle 25, which is positioned in the receptacle 28 on the one jaw member 16. Then, the deckhand places the jaw portion 14 onto the mooring post M (this could be a mooring cable instead), as shown in FIG. 4, and squeezes the lever 13 at the handle end of the pole 11. This draws the cable 50 proximally, and closes the two jaws 16 and 17. FIG. 4 shows the jaws partially closed, and FIG. 5 shows the jaws closed completely. This action moves the ring 27 of the shuttle into engagement with the detent 30. Then the cable tension is relieved, by loosening the squeeze lever 13, and the springs 23 pull the slide 18 and move the jaws 16, 17 back to their open position, as shown in FIG. 6. This action pulls the shuttle 25 out of the slot 29 on the first jaw 16, and holds it onto the second jaw 17. The mooring hook 10 can now be withdrawn, with the line L having been passed around the mooring post M from one side to the other. Then the deckhand can easily free the shuttle 25 from the detent 30 by pushing in on the release pin 37. The shuttle 25 is the only detachable part of this system, and is a small and simple device such that boaters can keep a plentiful supply of spares on hand, at relatively low cost. The boatman or deckhand can carry several of these in his or her pocket, so that the effect of accidentally dropping the shuttle overboard is not a significant setback. The shuttle members are preferably stamped or pressed metal members, but could be molded of a suitable plastic resin.

Alternatively, it is also possible to actuate the jaw members 16, 17 without using the lever 13 and cable 50, by thrusting the mooring hook 10 against the mooring post M. The post M presses the slide 18 in the proximal direction, which closes the jaw members 16, 17 behind the post M. Then, when force is relieved, the springs 23 return the jaw members 16, 17 to their open position, with the shuttle 25 retained in the detent mechanism 30.

Rather than the squeeze lever 13 as illustrated before, a small portable power device can be used to actuate the cable to open and close the jaws 16, 17. For example, a cordless screwdriver, e.g., a small hand-held power tool with an incorporated rechargeable battery, could be inserted into a socket at the proximal end of the pole 11, and actuated in the forward or reverse directions to draw in or relieve the cable. It is also possible to construct the mooring hook without the cable 40, in which case actuation would be achieved by pushing against the mooring post. The shuttle can be of metal or non-metal construction, as required, and can be of a different shape or design without departing from the principles of this invention. The fork and jaw members of the mooring hook can be shaped differently from what is shown here, with the design depending on the degree and type of duty likely to be required. The pole portion may also be of metal or non-metal construction.

While the invention has been described hereinabove with reference to a preferred embodiment and various alternatives thereto, it should be apparent that the invention is not limited to such embodiment(s). Rather, many variations would be apparent to persons of skill in the art without departing from the scope and spirit of this invention, as defined in the appended claims.

I claim:

1. Mooring hook for passing a mooring line around a mooring member, comprising a hook member attached onto a distal end of a suitable pole member; a shuttle member from which said mooring line extends proximally back of said hook member; said hook member having first and second jaw members and means selectively moving said jaw members between an open position and a closed position; said first jaw member including shuttle retaining means for holding said shuttle; said second jaw member including a releasable detent means for grabbing said shuttle when said jaw members move to their closed position and then pulling said shuttle free of said shuttle retaining means when said jaw members return to their open position so that the line attached to said shuttle passes freely behind said mooring member; and said pole member serving for placing said hook member over said mooring member and then withdrawing the hook member with the mooring line passing freely behind said mooring member.

2. Mooring hook according to claim 1 wherein said shuttle includes a rigid eye member having a loop onto which the mooring line is tied and eye means for engaging said detent means.

3. Mooring hook for passing a mooring line around a mooring member, comprising a shuttle member from which said mooring line extends; a hook member having first and second jaw members and means selectively moving said jaw members between an open position and a closed position; said first jaw member including shuttle retaining means for holding said shuttle; said second jaw member including a releasable detent means for grabbing said shuttle when said jaw members move to their closed position and then pulling said shuttle free of said shuttle retaining means when said jaw members return to their open position; and a suitable pole member on which said hook member is attached for placing said hook member over said mooring member and then withdrawing the hook member with the mooring line passing behind said mooring member; wherein said hook member includes a fork portion on which said first and second jaw members are pivotally mounted; a slide member mounted on said fork portion and constrained to move proximally-distally for a limited distance; first and second mechanical links connecting said slide member to said first and second jaw members respectively such that said jaw members move to their open position when the slide member moves distally and move to their closed position when the slide member moves proximally; and spring means for resiliently urging said slide member distally.

4. Mooring hook for passing a mooring line around a mooring member, comprising a shuttle member from which said mooring line extends; a hook member having first and second jaw members and means selectively moving said jaw members between an open position and a closed position; said first jaw member including shuttle retaining means for holding said shuttle; said second jaw member including a releasable detent means for grabbing said shuttle when said jaw members move to their closed position and then pulling said shuttle free of said shuttle retaining means when said jaw members return to their open position; and a suitable pole member on which said hook member is attached for placing said hook member over said mooring member and then withdrawing the hook member with the mooring line passing behind said mooring member; wherein said hook member includes an articulated neck that fits a distal end of said pole member to allow the hook member to be angled selectively with respect to the pole member.

5. Mooring hook according to claim 4 in which said neck includes a rotatable handle for locking the hook member at a selected angle relative to said pole member.

6. Mooring hook according to claim 3, further comprising a squeeze handle at a proximal end of said pole member and a control cable connected at one end to said squeeze handle and at the other end to said slide member.

7. Mooring hook according to claim 6 wherein said pole member is hollow and said control cable travels through an interior of the pole member from said squeeze handle to said slide member.

8. Mooring hook according to claim 7 wherein said pole member includes an outer tube portion and an inner tube portion that are slidable relative to one another to extend or shorten the pole member within a range, and further comprising means within said pole member for automatically adjusting the control cable length so that actuating the squeeze handle closes and opens the jaw members at any length of said pole member within said range.

9. A mooring hook for passing a mooring line around a mooring member comprising a shuttle member from which said mooring line extends; a hook member having first and second jaw members pivotally movable between an open position and a closed position; actuator means for moving said jaw members between said open and closed positions; said first jaw member including shuttle retaining means for releasably holding said shuttle, and said second jaw member including releasable detent means for grabbing said shuttle when said jaw members move to their closed position and then pulling said shuttle free of said shuttle retaining means when said jaw members return to their open position; an extendable tubular pole which is extendable over a range of lengths and having a handle actuator at a proximal end and a distal end on which said hook member is mounted; an actuator cable passing through said tubular pole and having a first cable half connected to said handle actuator, a second cable half connected to said actuator means, and a traveler mechanism within said tubular pole joining said first and second cable halves and automatically adjusting the length of said actuator cable so that actuating said handle actuator closes and opens said jaw members at any length of said adjustable tubular pole over said range.

10. The mooring hook according to claim 9 wherein said tubular pole includes an outer tube member affixed to said handle actuator; an inner tube member within said outer tube member and also affixed to said handle actuator; and an intermediate tube member that is slidable fitted into an annular space between said inner and outer tube members and onto which said hook member is attached; said traveler mechanism being disposed to travel within said inner tube member and having a first pulley over which said first cable half passes and a second pulley over which said second cable half passes, with one end of said first cable half being anchored to said intermediate tube member and one end of said second cable half being anchored to said inner tube member.

11. The mooring hook according to claim 10 further comprising an anchor pin securing said one end of the second cable half to a distal end of said inner tube member.

12. The mooring hook according to claim 10 wherein said inner tube member has a slot extending axially thereon and said intermediate tube member includes an anchor member at its proximal end onto which said one end of said first cable half is anchored.

13. The mooring hook according to claim 12 in which said anchor member protrudes inwardly through said slot.

14. The mooring hook according to claim 12 in which said traveler mechanism includes means protruding into said slot to prevent rotation of said traveler mechanism.

15. The mooring hook according to claim 10 wherein said traveler mechanism includes a block on which said first and second pulleys are pivotally mounted.

* * * * *